United States Patent [19]

Kircher

[11] 3,963,596

[45] June 15, 1976

[54] ELECTRODE ASSEMBLY FOR AN ELECTROLYTIC CELL

[75] Inventor: Morton S. Kircher, Oakville, Canada

[73] Assignee: Olin Corporation, New Haven, Conn.

[22] Filed: June 24, 1974

[21] Appl. No.: 482,296

[52] U.S. Cl. ..... 204/258; 204/266; 204/278; 204/286; 204/288

[51] Int. Cl.[2] ..... C25B 1/26; C25B 1/34; C25B 9/02; C25B 11/02

[58] Field of Search ..... 204/242, 252, 256, 266, 204/278, 286, 258, 288

[56] References Cited

UNITED STATES PATENTS

| | | | |
|---|---|---|---|
| 3,342,717 | 9/1967 | Leduc | 204/252 X |
| 3,477,938 | 11/1969 | Kircher | 204/266 |
| 3,498,903 | 3/1970 | Kamarjan | 204/266 |
| 3,591,483 | 7/1971 | Loftfield et al. | 204/266 X |

*Primary Examiner*—T. Tung
*Assistant Examiner*—A. C. Prescott
*Attorney, Agent, or Firm*—James B. Haglind; Donald F. Clements; Thomas P. O'Day

[57] ABSTRACT

An electrode assembly is provided for use in electrolytic cells employing metal electrodes. The electrode comprises two electrode surfaces, positioned in parallel and having a space between them, and at least one conductive support having one end attached substantially perpendicular to the electrode plate and having a section attached along a side of the electrode surface. This section has a portion having a curvature from about 2° to about 30° from an axis substantially perpendicular to the electrode plate.

The electrode assembly is employed in electrolytic cells for producing chlorine and caustic soda or oxychlorine compounds by the electrolysis of alkali metal chloride solutions.

21 Claims, 4 Drawing Figures

ELECTRODE ASSEMBLY FOR AN ELECTROLYTIC CELL

The invention refers to electrolytic cells for the electrolysis of aqueous salt solutions. More particularly this invention relates to electrode assemblies employed in electrolytic cells for the electrolysis of aqueous alkali metal chloride solutions.

Electrolytic cells have been extensively used in the preparation of chlorine and caustic or oxychlorine compounds such as chlorates by the electrolysis of brine in a number of different cell designs. One of the problems in all of these designs is to provide a satisfactory means for conducting current between the electrode wall or plate and the electrode surface.

The employment of metal electrodes as a replacement for graphite electrodes, particularly as the anode, has led to the development of electrodes, for example in diaphragm or chlorate cells, of increased size. The height of graphite anodes was limited to about 30 inches, by the electrical resistance of graphite and also by the maximum allowable gas void fraction in the inter-electrode gap. The use of highly conductive foraminous metal electrodes, however, permits employment of anodes having a height of at lleast 48 inches.

U.S. Pat. Nos. 3,591,483 and 3,707,454 issued to R. E. Loftfield et al., disclose anode assemblies for use with electrolytic cells where the cell bottom serves as the anode support and anode risers project upward from it and are attached to the anode surface.

An expandable electrode is disclosed in U.S. Pat. No. 3,674,676 where a riser, attached to the cell base, is commonly connected to two anode faces so that the distance between the anode faces can be adjusted while supplying current to the anode faces.

The above anode assemblies require they be used in cells having a horizontal base plate. In addition, they permit the unrestricted flow of fluids up thru the space between anode faces.

An improved electrode is therefore required which can be used in cells where the electrodes are secured to the side of the cells which will effectively conduct current between the electrode surface and the electrode plate; which will provide adequate support for the electrode surface; and which will permit electrodes of increased height to be used while requiring as short a length of conductor as is necessary to carry the required electrical current. In addition, the electrode will provide clear but restricted and directed flow of fluids up thru the electrode.

It is an object of the present invention to provide a novel electrode useful in electrolytic cells for the production of chlorine and oxychlorine compounds.

An additional object of this invention is to provide a novel electrode useful in electrolytic cells employing metal electrodes.

A further object of the present invention is to provide a novel electrode useful in electrolytic cells in which the electrode plates are positioned vertically.

Another object of the present invention is to provide a novel electrode permitting a continuous but restricted and directed flow of fluids thru the space between electrode surfaces.

These and other objects of the present invention are accomplished in an electrode suitable for use in a cell for the electrolysis of alkali metal chlorides which comprises two vertical electrode surfaces positioned in parallel and having a space between the electrode surfaces; at least one conductive support attached to the electrode surfaces and positioned in the space between the electrode surfaces, the conductive support having a portion having a curvature of from about 2° to about 30° from the horizontal. The portion of the conductive support having the curvature is from about 5 to about 95, and preferably from about 25 to about 90 percent of the length of the conductive support.

Accompanying FIGS. 1–4 illustrates the novel electrode assembly of the present invention. Corresponding parts have the same numbers in all figures.

Figures 1, 2, 3, 4:
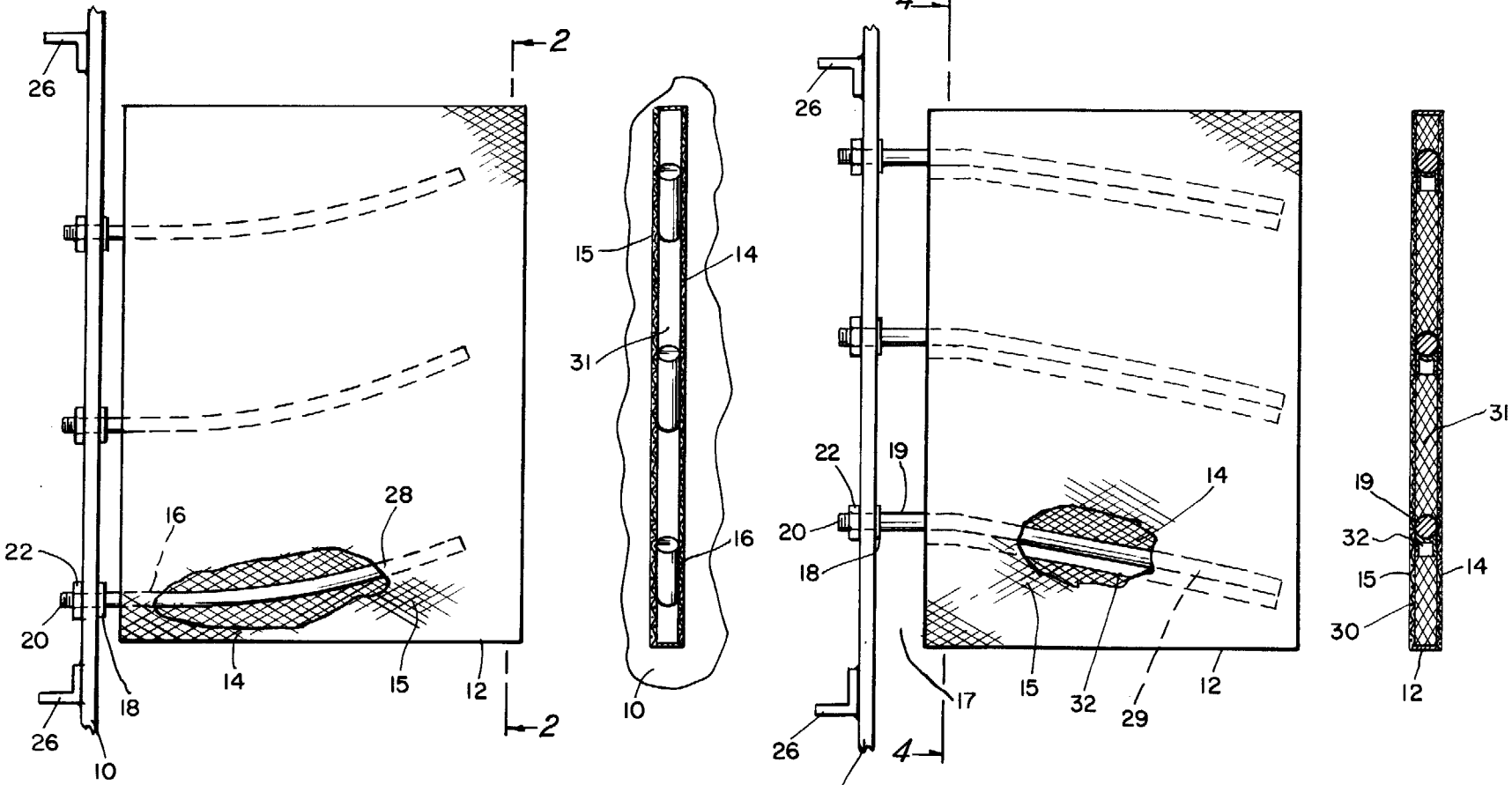
FIG. 1 illustrates a front elevation of the electrode assembly of the present invention.
FIG. 2 shows an end view of FIG. 1.
FIG. 3 illustrates a front elevation of an alternate embodiment of the electrode assembly of the present invention.
FIG. 4 shows a cross section taken along line 4—4 of FIG. 3.

The electrode assembly in FIG. 1 employs an electrode plate 10 having electrode 13 attached. Electrode 12 is composed of near electrode surface 15 and far electrode surface 14 positioned in parallel and having a space (not shown) between them. Conductive supports 16 have flanges 18 attached near threaded ends 20. Threaded ends 20 of conductive supports 16 pass through openings (not shown) in electrode plate 10, and are secured by nuts 22. Conductive supports 16 are positioned in the space between and attached along one side of electrode surfaces 14 and 15. A portion 28 of each of the conductive supports 16 attached to electrode surfaces 14 and 15 is curved upward. Conductive supports 16 terminate before reaching the front edges of electrode surfaces 14 and 15. Conductive supports 16 are attached along the sides of electrode surfaces 14 and 15 by welding, brazing or the like. Conductors 26 are welded to electrode plate 10 to provide means for introducing current to the electrode assembly.

In FIG. 2, electrode plate 10 has a plurality of conductive supports 16 attached perpendicularly to electrode plate 10. Conductive supports 16 are positioned in space 31 between electrode surfaces 14 and 15 and curve upward. Conductive supports 16 are attached along the sides of electrode surfaces 14 and 15.

In an alternate embodiment illustrated in FIG. 3, the electrode assembly employs electrode plate 10 having electrode 12 attached. Electrode 12 is composed of near electrode surface 15 and far electrode surface 14. Electrode surfaces 14 and 15 are positioned in parallel and have a space (not shown) between them. Conductive supports 19 are positioned within the space between electrode surface 14 and electrode surface 15, and are attached along a side of each electrode surface by welding, brazing or the like. Gas directing elements 32 are positioned below conductive supports 16 and are attached to electrode surfaces 14 and 15 in the same manner as conductive supports 16.

The rear edges of electrode surface 14 and 15 are spaced apart from electrode plate 10 to provide channel 17 between electrode plate 10 and electrode surfaces 14 and 15.

A portion of conductive supports 19 which is attached along side of each of the electrode surfaces has a downward curvature. Conductive supports 19 have flanges 18 near threaded ends 20 and are attached to electrode plate 10 in the same manner as shown in FIG. 1.

In the cross sectional view shown in FIG. 4, electrode 12 is composed of electrode surfaces 14 and 15 positioned in parallel and spaced apart, and conductive supports 19 positioned in space 31 between electrode surfaces 14 and 15 and attached to each of the electrode surfaces 14 and 15. Partition 30 joins an edge of electrode surface 14 with an edge of electrode surface 15 and closes space 31 between the two electrode surfaces. Partition 30 contains openings (not shown) for conductive supports 19. Partition 30 also contains gas directing elements 32 located below conductive supports 19. Partition 30 is joined to electrode surfaces 14 and 15 by means such as welding, brazing or the like.

The electrode includes at least one conductive support which is attached at one end substantially perpendicular to the electrode plate and has a section attached along the sides of both electrode surfaces. The conductive support is positioned between the electrode surfaces and therefore attached along the side of the electrode surfaces not facing an adjacent oppositely charged electrode. The conductive support may be attached parallel to the length or width of the electrode surface. A portion of this section attached along the side of the electrode surfaces has a curvature from an axis perpendicular to the electrode plate. The curvature is in the vertical direction. The amount of curvature is from about 2 to about 30 and preferably from about 5° to about 20° from the horizontal.

The curvature may be a continuous curve, for example, an arc or a non-continuous curve such as a bend or turn. A preferred embodiment is a non-continuous curve such as a bend.

The curved portion may be from about 5 to about 100, preferably from about 25 to about 95, and more preferably from about 50 to about 95 percent of the length of the section attached along the side of the electrode surfaces.

It is preferred that the portion having a curvature be an integral unit with the straight section of the conductive support. However, if desired, the portion having a curvature may be a separate unit which is, for example, adjustably attached to the straight section of the conductive support to permit changing the amount of curvature.

The conductive support is attached along each side of the two electrode surfaces to provide a space or channel for the fluids which are directed along the conductive supports to rise. For example, where the curvature of the portion of the conductive support is in an upward direction, it is preferable to terminate the conductive support at a distance from the front or leading edge of the electrode surfaces. This distance may be any conveniently selected distance and is dependent, for example on the size of the electrode surface. Where the width of the electrode surface is about 36 inches, for example, the distance from the end of the conductive support to the front edge of the electrode surface is about 6 inches.

When a curvature of the portion of the conductive support is downward, a channel is provided by attaching the electrode surfaces to the conductive supports at a distance from the electrode plate, this distance can be, for example, from about 1 to about 6, and preferably from about 1.5 to about 4 inches.

The width or diameter of the conductive support determines the distance that the electrode surfaces are spaced apart. Any convenient physical form of conductive support may be used such as rods, strips, bars, or channels, A preferred form of conductive support is a rod having a diameter of from about 0.50 to about 5 inches and preferably from about 0.75 to about 2 inches.

An additional embodiment, as illustrated in FIG. 4, is the use of gas directing element 32 when the conductive support is in the form of, for example, a rod, bar or strip. The gas directing element is positioned immediately below the conductive support and along substantially the entire length of the conductive support which is attached to the electrode surfaces. The gas directing element prevents accumulated gases from passing through openings in the electrode surfaces. It may be, for example, a pair of strips, one strip attached along the side of each electrode surface or it may be in the form of a channel whose upper edge conforms to the shape of the conductive support.

The gas directing element may be composed of a non-conductive material such as Plexiglas or polytetrafluoroethylene or a conductive material of the type used for the conductive support.

As shown in FIG. 4, in an additional embodiment, a foraminous partition closes the space between the electrode surfaces by joining the edges of the electrode surfaces nearest the electrode plate. The partition has openings for the conductive supports and in addition, in a preferred embodiment, has an aperture located below the opening for each conductive support. The aperture may be of any convenient shape such as square, rectangular or circular. The aperture is preferably a rectangle having a length of from about 2 to about 10 and a width from about 0.5 to about 5, and more preferably a length from about 2 to about 5 and a width of from about 0.75 to about 3 inches.

Similarly, the electrode surfaces may be joined across the front or leading edge by attaching, for example, a partition. The partitions may be composed of any suitable electro-conductive material which is compatible with that of the electrode surfaces. However, it is preferred that the partitions be made of the same material as that used for the electrode surfaces. The partitions may be attached by means such as soldering, welding, brazing or the like. If desired, the electrode surfaces may also be joined along the other edges. This is required where, for example, the electrode serves as a cathode in a diaphragm cell. The electrode surfaces are sealed along the edges and the electrode surfaces are also attached to the electrode plate to form a catholyte compartment. A diaphragm is attached or deposited on the electrode surfaces of the cathode and outlets are provided for the removal of gaseous and liquid products from the cathode compartment.

In electrodes where a plurality of conductive supports are employed the number of conductive supports is generally dependent on the size of the electrode surfaces. Where the height of the electrode surface is for example, about 48 inches, a plurality of conductive supports comprises for example, from about 2 to about 10 and preferably from about 3 to 7 conductive supports.

When the height of the electrode is greater, more conductive supports may be attached to each electrode surface, and where the height of the electrode is shorter, fewer conductive supports may be used.

Where a plurality of conductive supports is used, the spacing between adjacent supports may be regular or irregular. Preferably the spacing between adjacent conductive supports is from about 6 to about 15 inches.

Any convenient physical form of conductive support may be used such as rods, strips or bars. A preferred form of conductive support is a rod having a diameter of from about 0.25 to about 3 inches and preferably from about 0.5 to about 1.5 inches.

The electrode assembly of the present invention may be employed as an anode or a cathode, for example, in electrolytic cells suitable for the production of chlorine and caustic soda or oxychlorine compounds such as hypochlorites or chlorates.

It will be understood that, depending on whether the electrode assembly of the present invention serves as the anode or cathode, the materials of construction for the conductive support will be suitably selected to be resistant to the gases and liquids to which it is exposed. For example, when serving as an anode, the conductive support is suitably a conductive metal such as copper, silver, steel, magnesium or aluminum covered by a chlorine-resistant metal such as titanium or tantalum. Where the electrode assembly serves as the cathode, the conductive support is suitably, for example, steel, nickel, copper or coated conductive materials such as nickel coated copper.

Where the electrode surface serves as the anode, a foraminous metal which is a good electrical conductor may be used. It is preferred to employ a valve metal such as titanium or tantalum or a metal, for example, steel, copper or aluminum clad with a valve metal such as tantalum or titanium. The valve metal has a thin coating over at least part of its surface of a platinum group metal, platinum group metal oxide, an alloy of a platinum group metal or a mixture thereof. The term "platinum group metal" as used in the specification means an element of the group consisting of ruthenium, rhodium, palladium, osmium, iridium, and platinum.

The anode surfaces may be in various forms such as an expanded mesh which is flattened or unflattened, and having slits horizontally, vertically or angularly. Other suitable forms include woven wire cloth, which is flattened or unflattened, bars, wires, or strips arranged, for example, vertically, and sheets or plates having perforations, slits or louvered openings.

A preferred anode surface is a foraminous metal mesh having good electrical conductivity in the vertical direction.

As the cathode, the electrode surface is suitably a metal screen or mesh where the metal is, for example, iron, steel, nickel, or tantalum. If desired, at least a portion of the cathode surface may be coated with a platinum group metal, oxide or alloy as defined above.

The electrode plates are suitably constructed of non-conductive materials, such as concrete or fiber-reinforced plastic or a conductive metal such as steel or copper. To avoid corrosive damage, the conductive metal may be covered with, for example, hard rubber or a plastic such as polytetrafluoroethylene or fiber-reinforced plastic. If desired, titanium or a titanium-clad base metal may be used where the electrode plate serves as the anode plate.

Openings are provided in the electrode plate for attaching one end of the conductive supports. These openings may be holes of about the same size as the diameter or cross section of the conductive support. In a preferred embodiment, the openings permit lateral movement of the conductive supports to allow the spacing between the anode and the cathode to be varied. Slots, key holes, grooves and the like are suitable openings for permitting lateral movement of the conductive support. One end of the conductive support is attached to the electrode plate by any suitable means such as bolting.

Each electrode surface is attached to its conductive support, for example, by welding, soldering, brazing or the like.

In a preferred embodiment, the electrode assembly of the present invention is used in a diaphragm cell where the electrode plates are positioned vertically. The anode plate has a plurality of anodes attached and the cathode plate, which is vertically positioned and opposite the anode plate has a plurality of cathodes attached. The anodes and cathodes project horizontally across the cell and when the cell is assembled, each cathode is inserted between two adjacent anodes.

Where a plurality of electrodes are attached to the electrode plates, the exact number depends on the size of the electrode plate. For example, in an electroyltic cell employing the electrode assembly of the present invention, from about 5 to about 50 electrodes are attached to the electrode plate.

The electrode assembly of the present invention may be employed in electroyltic cells for the electrolysis of aqueous salt solutions, for example, an alkali metal chloride such as sodium chloride or potassium chloride. Where a diaphragm or permselective cation-exchange membrane is employed, chlorine and an alkali metal hydroxide are produced. If the diaphragm or membrane is omitted, oxychlorine compounds such as alkali metal hypochlorites or alkali metal chlorates are obtained. Illustrative types of diaphragm cells include those of U.S. Pat. Nos. 1,862,244; 2,370,087; 2,987,463; 3,461,057; 3,617,461 and 3,642,604.

Particularly suitable are diaphragm cells in which the electrodes and cathodes are mounted on opposite side walls of the cell, for example, in U.S. Pat. Nos. 3,247,090 or 3,477,938. Suitable examples of non-diaphragm cells include U.S. Pat. Nos. 3,700,582 and 3,732,153.

The following examples are presented to illustrate the invention more fully. All parts and percentages are by weight unless otherwise indicated.

EXAMPLE 1

A sealed container of Plexiglas, 40 inches long, 63 inches high and 3 inches wide was used to simulate an electrolytic cell. The transparent walls of the container permitted visual observation of gas and liquid flow in the interior of an electrode such as illustrated in FIG. 3. The electrode surface was 36 inch wide by 48 inch high titanium mesh surface with suitable structural bracing. Between the titanium mesh surface and a transparent side wall was a space 1.5 inches wide in which four polyvinyl chloride rods 0.84 inch in diameter were placed to simulate electrode conductive supports. The rods, sloped at an angle of 16° from the horizontal, were wired to the titanium mesh. Directly below the lowermost rod, a Plexiglas strip 1.5 inches wide and 0.16 inch thick was wired to the titanium mesh and served as a gas guiding element. Air was bubbled into the cell to simulate the action of chlorine or hydrogen.

To provide air bubbles, a polyvinyl chloride pipe, 0.54 inch in diameter having holes 0.0135 inch diameter and spaced apart 0.5 inch was inserted in the cell just below the lower edges of the electrode surfaces within the intra electrode space and parallel to the length of the electrode surfaces. The pipe was connected to a rotameter and an air pump. An inlet-outlet valve for water was located at the bottom of the cell near the center. The cell was filled with water to a lever of about one-half of the electrode height and air introduced at varying rates. A visual observation was made to determine the amount of air which would be directed along the bottom rod and up the channel between the electrode plate and the rear edges of the electrode surfaces as compared to the amount of air which would pass thru the mesh of the electrode surface and pass up the side of the electrode surface. The results are shown in Table I below.

Table I

Gas Flow Along Rods Sloping Downward at an Angle of 16° from the Horizontal (Channel between Electrode Plate and Electrode Surfaces = 1.5 inches)

| Run No. | Amount of Air Introduced (cubic feet per minute) | Percent of Bubbles Flowing Along Rod |
|---|---|---|
| 1 | .2 | 99.5 |
| 2 | .3 | 99 |
| 3 | .4 | 97 |
| 4 | .5 | 90 |
| 5 | .6 | 85 |
| 6 | .7 | 75 |
| 7 | .8 | 65 |
| 8 | .9 | 60 |
| 9 | 1.0 | 55 |

The above results show that the sloped rod was effective at directing the flow of gas along the rod to the channel at the rear of the electrode surface.

EXAMPLE 2

The procedure of Example 1 was repeated with the rods sloped downward at an angle of 8° from the horizontal. The results are shown in Table II as follows.

Table II

Gas Flow Along Rods Sloping Downward at an Angle of 8° from the Horizontal (Channel between Electrode Plate and Electrode Surfaces = 1.5 inches)

| Run No. | Amount of Air Introduced (cubic feet per minute) | Percent of Bubbles Flowing Along Rod |
|---|---|---|
| 11 | .2 | 98 |
| 12 | .3 | 97 |
| 13 | .4 | 93 |
| 14 | .5 | 90 |
| 15 | .6 | 88 |
| 16 | .7 | 83 |
| 17 | .8 | 78 |
| 18 | .9 | 63 |
| 19 | 1.0 | 53 |

Effective direction of air flow was obtained along sloped rods, particularly at air flows of from 0.2 to 0.6 cubic feet per minute.

When employing an anode assembly in a diaphragm cell having two electrode surfaces attached to a plurality of conductive supports in the manner illustrated in FIGS. 3 and 4, where a partition joins the front edges of the electrode surfaces and a partition having apertures, joins the rear edges of the electrode surfaces, the flow of fluids (liquid and gas) is directed along the conductive supports. The flow is directed from right to left to the "chimney" or channel area between the electrode plate and the partition joining the rear edges of the electrode surfaces. In this chimney area, the fluids flow upward at a higher rate than the flow along the conductive support. This creates a circulation effect (draft) which draws electrolyte thru the front partition into the intra-electrode surface space and sweeps the gases toward the chimney area. The flow of liquids and gases is thus restricted and directed to provide improved electrolyte and gas circulation thru the electrode while minimizing contact with or "scrubbing" of the diaphragm by the fluid flow.

What is claimed is:

1. An electrode suitable for use in a cell for the electrolysis of alkali metal chloride solutions which comprises:

a. two vertical electrode surfaces positioned in parallel and having a space between said electrode surfaces, b. at least one conductive support attached to said electrode surfaces and positoned in said space between and parallel to said electrode surfaces, said conductive support having a portion having a curvature of from about 2 to about 30 degrees from the horizontal, and c. a gas directing element positioned immediately below said conductive support and attached to a side of said electrode surfaces.

2. The electrode of claim 1 in whch said portion having said curvature is from about 5 to about 95 percent of the length of said conductive support.

3. The electrode of claim 2 in which said portion having said curvature is from about 25 to about 90 percent of the length of said conductive support.

4. The electrode of claim 3 in which said conductive support is a rod.

5. The electrode of claim 1 in which said curvature is from about 5° to about 20° from the horizontal.

6. The electrode of claim 1 having a first partition joining the rear edges of said electrode surfaces and closing the space between said electrode surfaces said partition having an opening for said conductive support.

7. The electrode of claim 6 having an aperture in said first partition below said opening for said conductive support.

8. The electrode of claim 6 having a second partition joining the front edges of said electrode surfaces and closing said space between said electrode surfaces.

9. The electrode of claim 1 having a plurality of from about 2 to about 10 conductive supports.

10. The electrode of claim 1 in which said gas directing element comprises a pair of strips, one said strip being attached along a side of each of said electrode surfaces.

11. The electrode of claim 1 in which said gas directing element comprises a channel having an upper edge which conforms to the shape of said conductive support.

12. An electrode assembly suitable for use in an electrolytic cell for the electrolysis of alkali metal chlorides comprising:

a. an electrode plate positioned vertically, b. two vertical electrode surfaces positioned in parallel and having a space between said electrode surfaces, c. at least one conductive support positioned in said space between and parallel to said electrode surfaces, having one end attached substantially perpendicular to said electrode plate and a section attached along a side of said electrode surfaces, said section having means for providing a portion of said section with a curvature of from about 2° to about 30° from an axis perpendicular to said electrode plate, and d. a gas directing element positioned immediately below said conductive support and attached along a side of said electrode surfaces.

13. The electrode assembly of claim 12 in which said portion having a curvature is from about 5 to 100 percent of the length of said section attached along said side of said electrode surfaces.

14. The electrode assembly of claim 13 in which said portion having a curvature is from about 25 to about 95 percent of the length of said section attached along said side of said electrode surfaces.

15. The electrode assembly of claim 12 in which said curvature is non-continuous in the form of a bend of from about 5° to about 20° from an axis perpendicular to said electrode plate.

16. The electrode assembly of claim 15 in which the end of said conductive support attached along said side of said electrode surfaces is spaced from the front edges of said electrode surfaces, to provide a chimney area, the direction of said curvature is upward, and said electrode is suitable for use as an anode.

17. A diaphragm cell for the electrolysis of an aqueous solution of an alkali metal chloride containing the electrode assembly of claim 16 and at least one cathode having a diaphragm thereon, wherein, said cathode is attached to a cathode plate positioned vertically and opposite said anode assembly, and said cell having means for supplying electric current to said conductive supports.

18. The electrode assembly of claim 15 in which the rear edges of said electrode surfaces are spaced apart from said electrode plate to provide a chimney area, the direction of said curvature is downward, and said electrode is suitable for use as a cathode.

19. A diaphragm cell for the electrolysis of an aqueous solution of an alkali metal chloride containing the electrode assembly of claim 18 wherein said electrode surfaces have a diaphragm thereon, and at least one anode attached to an anode plate positioned vertically and opposite said cathode assembly, and said cell having means for supplying electric current to said conductive supports.

20. The electrode assembly of claim 12 in which said gas directing element comprises a pair of strips, one said strip being attached along a side of each of said electrode surfaces.

21. The electrode assembly of claim 9 in which said gas directing element comprises a channel having an upper edge which conforms to the shape of said conductive support.

* * * * *

PO-1050
(5/69)

UNITED STATES PATENT OFFICE
CERTIFICATE OF CORRECTION

Patent No. 3,963,596 Dated June 15, 1976

Inventor(s) Morton S. Kircher

It is certified that error appears in the above-identified patent and that said Letters Patent are hereby corrected as shown below:

Column 1, line 5, delete "refers" and insert --relates--.

Column 1, line 26, delete "lleast" and insert --least--.

Column 2, line 22, delete "13" and insert --12--.

Column 7, line 2, delete "lever" and insert --level--.

Column 7, line 68, place quotation marks around the word "chimney".

Column 8, Claim 2, line 26, delete "whch" and insert --which--.

Column 8, Claim 6, line 38, after "surfaces" insert --,--.

Column 10, Claim 21, line 24, delete "9" and insert --12--.

Signed and Sealed this

First Day of February 1977

[SEAL]

*Attest:*

RUTH C. MASON
*Attesting Officer*

C. MARSHALL DANN
*Commissioner of Patents and Trademarks*